United States Patent [19]

Jones

[11] Patent Number: 4,864,675

[45] Date of Patent: Sep. 12, 1989

[54] BUTTERFLY SPONGE MOP

[75] Inventor: David A. Jones, Dayton, Ohio

[73] Assignee: The Drackett Company, Cincinnati, Ohio

[21] Appl. No.: 148,523

[22] Filed: Jan. 25, 1988

[51] Int. Cl.[4] ..... A47L 13/12

[52] U.S. Cl. ..... 15/119 A; 15/116.2; 15/118

[58] Field of Search ..... 15/116.1, 116.2, 119 R, 15/119 A, 118

[56] References Cited

U.S. PATENT DOCUMENTS

| | | | |
|---|---|---|---|
| 2,685,098 | 8/1954 | Palma, Jr. et al. . | |
| 2,725,585 | 2/1955 | Vosbikian et al. . | |
| 2,730,742 | 1/1956 | Zottola . | |
| 2,730,743 | 1/1956 | Zottola . | |
| 2,757,398 | 8/1956 | Richards et al. . | |
| 2,883,689 | 4/1959 | Vosbikian et al. . | |
| 2,887,704 | 5/1959 | Vosbikian et al. | 15/116.2 |
| 2,967,317 | 1/1961 | Richards . | |
| 3,147,502 | 9/1964 | Richards . | |

FOREIGN PATENT DOCUMENTS

| | | |
|---|---|---|
| 496850 | 11/1950 | Belgium . |
| 697400 | 9/1953 | United Kingdom . |

OTHER PUBLICATIONS

MEGA MOP by Empire Brushes, Inc., Greenville, N.C.

*Primary Examiner*—Harvey C. Hornsby
*Assistant Examiner*—Corinne M. Reinckens
*Attorney, Agent, or Firm*—Gene Warzecha

[57] ABSTRACT

A butterfly-type sponge mop with presser plates and an actuating member pivotal relative to a center block. The mop includes a top center block which when interlocked with a bottom center block forms a plurality of bearing surfaces to enable motion of the presser plates about a transverse axis and motion of the actuating member about a longitudinal axis. The mop utilizes a generally loop-shaped actuating member to facilitate assembly without compression of the actuating member. The actuating member is connected to a connecting link which is actuated by a slide handle. A novel connecting means is utilized to enable a predetermined amount of rotation between the actuating member and the connecting link without the need for additional parts to retain same together.

1 Claim, 5 Drawing Sheets

FIG. 4
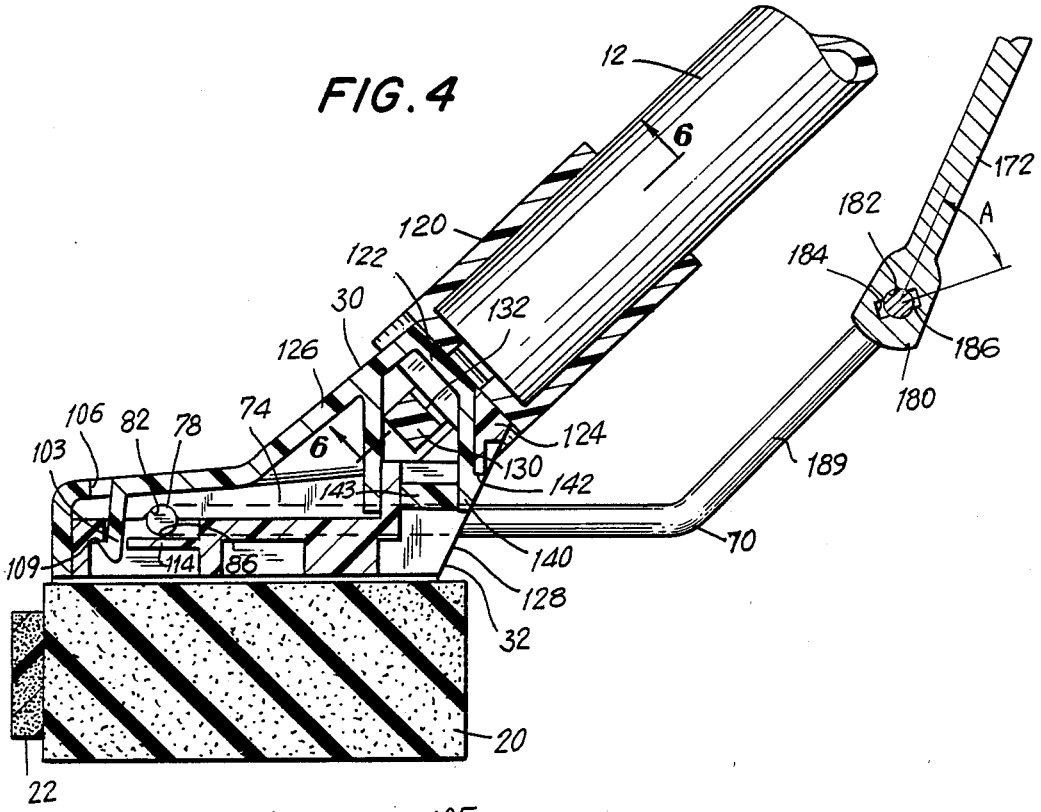
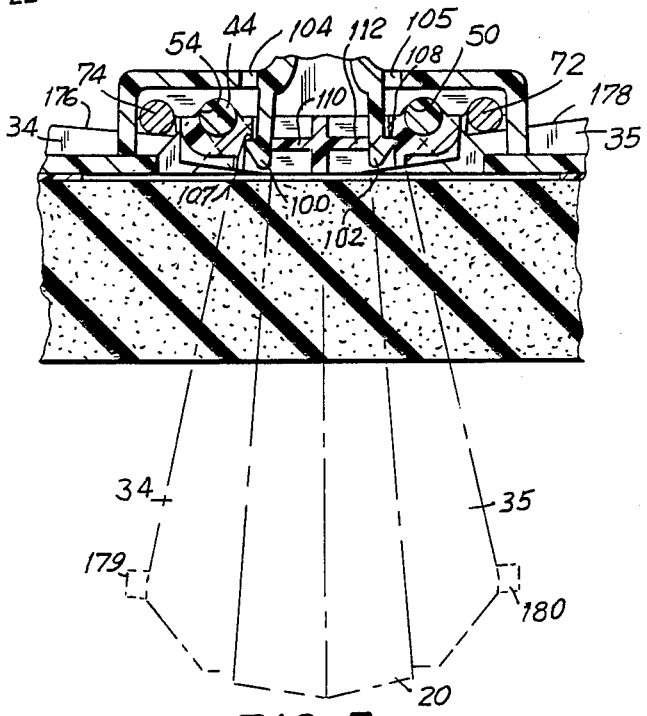
FIG. 5
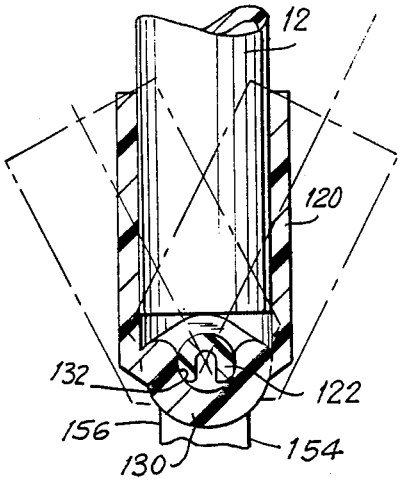
FIG. 6

FIG. 7
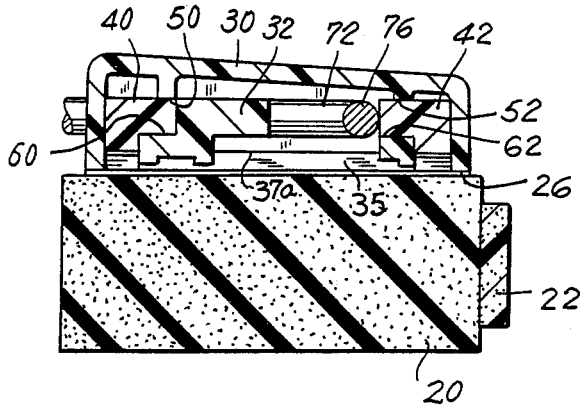
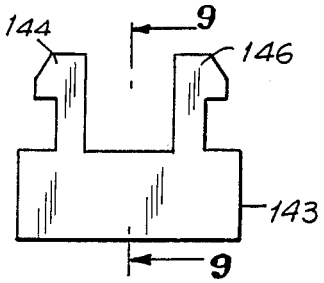
FIG. 8
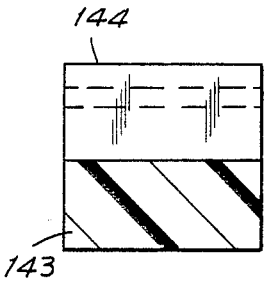
FIG. 9

BUTTERFLY SPONGE MOP

This is a continuing application of Application Ser. No. 864,615 filed May 19, 1986.

BACKGROUND OF THE INVENTION

1. Field of the Invention

This invention relates generally to sponge mops and mechanisms for wringing out same. More particularly, the invention relates to sponge mops with wringing mechanisms for transversely squeezing together two halves of a substantially rectangular sponge mop.

2. Description of the Prior Art

Wringable sponge mops using generally rectangular sponges are known in the prior art and generally fall in two categories. The first category consists of sponge mops which may be wrung out by squeezing two halves of the sponge together along a longitudinal line along the length of the sponge such as shown, for example, in U.S. Pat. No. 3,050,761 issued to Morgan. Such mops are generally disadvantageous in that considerable force is required to wring out the sponge along such a direction.

The second category of sponge mops consists of butterfly-type sponge mops which are wrung out by squeezing the two halves of the sponge together along a transverse line that is aligned with the mop handle. Such mops are shown, for example, in U.S. Pat. No. 2,967,317 (Richards) and U.K. Pat. No. 697,400.

There is also known a butterfly mop called MEGA MOP (marketed by Empire Brushes, Inc., U.S. Highway 13 North, Greenville, N.C. 27835) which includes presser plates and a center block made of plastic. The actuating member and the pressure plates are each provided with portions thereof which serve as pivot shafts which are inserted in corresponding apertures in the center block to enable the actuating member and presser plates to be hinged relative to the block. Because of the desired direction of movement, the center block must be provided with vertical side walls transverse to the plane of the sponge and the pivot apertures must be set in these vertical side walls. The manufacture of center blocks for this type of mop requires a costly multi-action slide mold in order to produce the required apertures. Additionally, the assembly of this mop is more costly and time consuming because of the way the pieces must be snapped together and because the arms of the actuating member must be compressed in order to fit into the center block.

In butterfly-type sponge mops the actuating member which pivots relative to the mop head must be pivotally connected to a connecting link which is moved by a handle to operate the wringing feature. In prior art mops the connection of the actuating member to the connecting link often requires one or more additional components or assembly steps, thus adding to the cost and complexity of prior art units.

It is, therefore, an object of the present invention to produce a butterfly mop which may be relatively easily manufactured and assembled. It is a further object of this invention to provide the main component parts of a butterfly-type mop which may be produced in a simple one-step molding process. It is yet another object of this invention to provide a butterfly-type mop in which the main component parts lock together without the need for additional retaining hardware. It is a further object of this invention to provide means for attaching the actuating member to the connecting link without the need for additional components.

SUMMARY OF THE INVENTION

These and other objects of the invention are achieved by the preferred embodiment thereof which comprises a butterfly-type sponge mop comprising:

a spong;

a pair of presser plates for being secured to said sponge, each presser plate having a pair of transversely aligned pivot shafts at the proximate end thereof;

a generally loop shaped actuating member having two substantially parallel sides, each of said sides situated above the proximate end of a respective one of said presser plates, each of said sides having ends extending transversely thereto, said ends aligned toward each other;

a top center block for mateable engagement with said pressure plates and said actuating member, said top center block provided with:

(a) longitudinally aligned first detent means for partially receiving therein said ends, (b) transversely aligned second detent means for partially receiving therein the aligned pivot shafts of one of said presser plates, (c) transversely aligned third detent means spaced from and parallel to said second detent means for receiving therein the aligned pivot shafts of the other of said pressure plates;

a bottom center block for mateable engagement with said top center block, said bottom center block provided with:

(a) fourth detent means for cooperating with said first detent means to provide a first longitudinal pivot axis for said actuating member;

(b) fifth and sixth detent means for cooperating with said second and third detent means, respectively, to provide second and third transverse pivot axes, respectively, for said presser plates;

means for retaining said top and bottom center blocks together;

means for actuating said actuating member to pivot same about said first axis, thereby pivoting said presser plates toward each other about said second and third pivot axes.

BRIEF DESCRIPTION OF THE DRAWINGS

FIG. 4 is a cross-sectional elevation view of FIG. 2 taken along the line 4—4.

FIG. 5 is a cross-sectional elevation view of a portion of FIG. 2 taken along the line 5—5, with the position of a portion of the sponge mop during operation shown in phantom.

FIG. 6 is a plan view of the swivel socket shown in FIG. 4 taken along the line 6—6 thereof.

FIG. 7 is a cross-sectional view of a portion of FIG. 2 taken along the line 7—7.

FIG. 8 is a front elevation view of a locking key for use with the sponge mop of FIG. 1.

FIG. 9 is a side elevation view of the locking key.

DESCRIPTION OF THE PREFERRED EMBODIMENT

Figure 1:
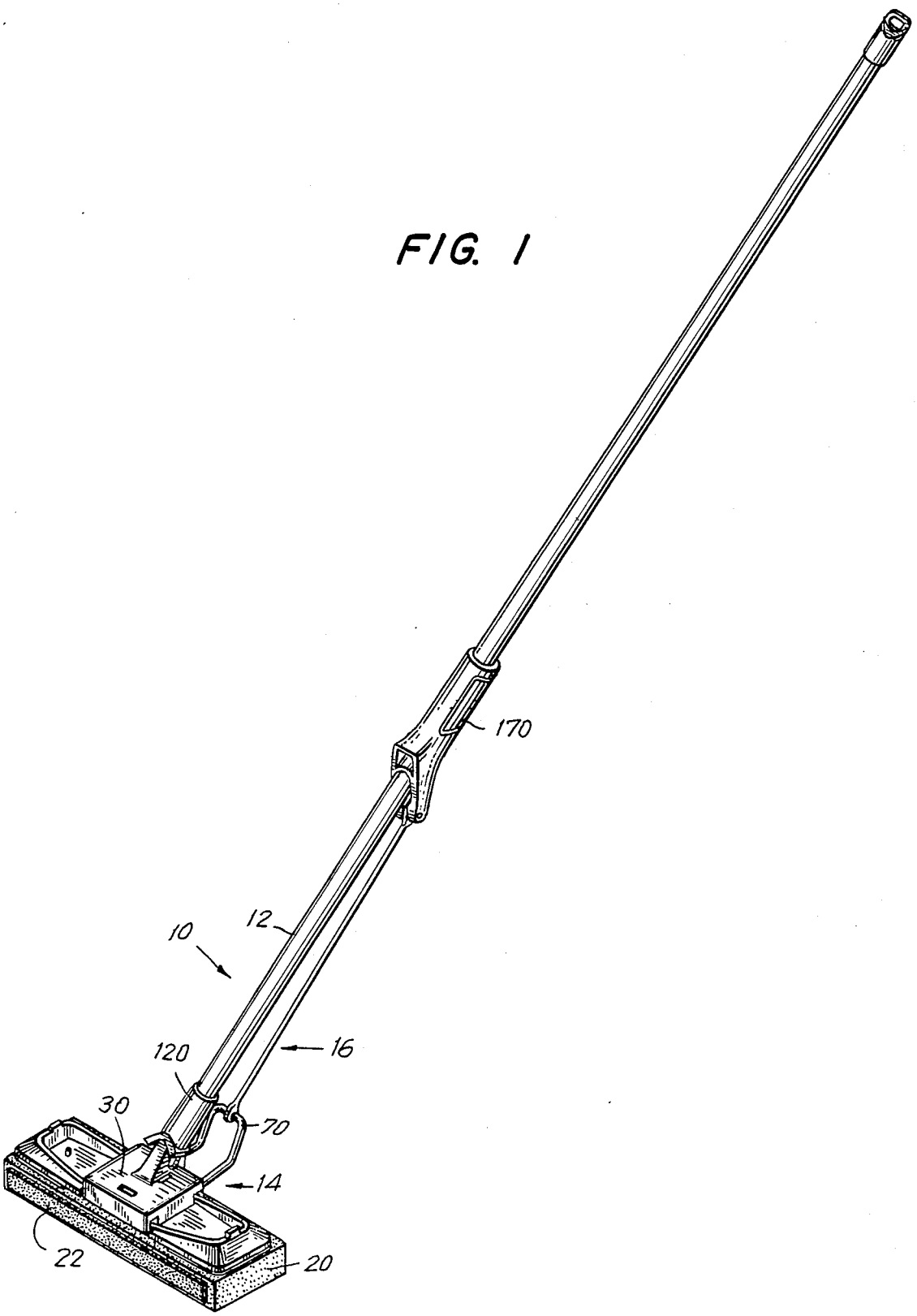
FIG. 1 is a perspective view of a sponge mop constructed in accordance with the principles of this invention.

Referring now to FIG. 1, there is shown a butterfly type sponge mop 10 constructed in accordance with the principles of this invention. Mop 10 comprises a handle 12, a mop head 14 and an actuating mechanism 16 for compressing the sponge mop as will be more fully explained below.

Figure 2:
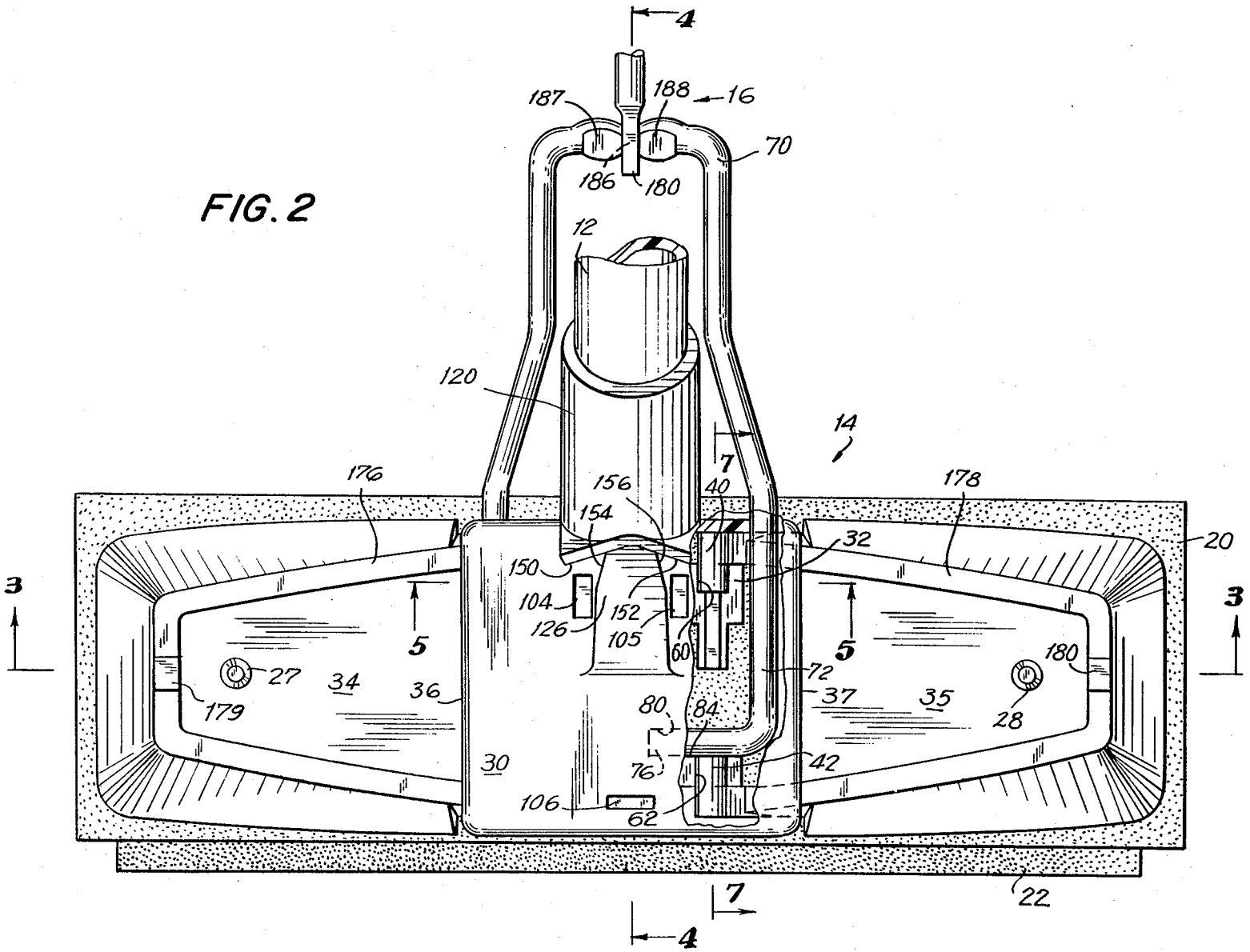
FIG. 2 is a top plan view of the head of the sponge mop shown in FIG. 1, partially in cross-section.

Referring now to FIG. 2, there is shown a plan view of mop head 14, partially in cross-section. Mop head 14 includes a conventional spong 20 which may be provided with a scrubber strip 22 along one edge thereof. Sponge 20 has bonded to one side thereof backing plates 24 and 26 (best seen in FIG. 3) provided with retaining pins 27 and 28, respectively, molded therein.

Mop head 14 further comprises a top center block 30, bottom center block 32 and presser plates 34 and 35. Presser plates 34 and 35 are provided with apertures 38 and 39, respectively, for receiving retaining pins 27 and 28 therethrough in order to secure sponge 20 to the pressure plates.

Top and center block has vertical side walls which, because of the principles of the invention, need not have apertures. Transverse side walls 36 and 37 do have cut-outs (best seen in FIG. 1) to receive the ramp surfaces of presser plates 34 and 35. The bottom edges **36*a* and 37*a* of these side walls serve to limit upward rotation of presser plates 34 and 35**.

Presser plates 34 and 35 are identical. Presser plate 35 is provided with a pair of aligned pivot shafts 40 and 42 (best seen in FIG. 2). While presser plate 34 is identical to presser plate 35, its pivot shafts will be designated 44 and 46 (not shown) in order to facilitate the description of the drawings. Pivot shafts 40 and 42 are situated along the proximate end of presser plate 35 and enable it to be pivoted about an axis transverse to the length of sponge 20. Each pivot shaft 40 and 42 is intended to cooperate with a semi-circular detent 50 and 52 (best seen in FIG. 7) formed in the bottom of top center block 30. Similarly, pivot pins 44 and 46 are intended to mate with semi-circular detent 54 and 56 (not shown). Pivot pins 40, 42 and 44, 46 are retained adjacent their respective detents (50, 52 and 54, 56) by cooperating semi-circular detents 60, 62 (best seen in FIG. 7) and 64, 66 (not shown), respectively, in the top surface of center block 32 as will be better understood below. The cooperating detents serve as bearing surfaces to enable pivotal motion of the presser plates.

Actuating mechanism 16 comprises an actuating member 70 having a pair of parallel arms 72 and 74 and a pair of aligned ends 76 and 78. Ends 76 and 78 are intended to be partially retained within semi-circular detents 80 and 82, respectively, in the bottom surface of top center block 30. Semi-circular detents 80 and 82 (best seen in FIG. 4) are intended to cooperate with corresponding detents 84 and 86 formed in the upper surface of bottom center block 32. The cooperating action of semi-circular detents 80, 82 and 84, 86 form a longitudinal bearing surface for actuating member 70, as will be better understood below.

Top and bottom center blocks 30 and 32 are intended to be interlocked by the cooperative action of a plurality of locking arms and corresponding tabs. Top center block 30 is provided with locking tabs 100, 102 and 103 (best seen in FIGS. 4 and 5). Apertures 104, 105 and 106 are formed in the top surface of top center block 30 during the molding process. Locking arms 100, 102 and 103 cooperate with locking edges 107, 108 and 109 in order to secure top and bottom center blocks together. Reinforcing tabs 110, 112 and 114 molded into bottom center block 32 assist in maintaining locking engagement between the various locking arms and edges.

Sponge mop 10 is also provided with means to facilitate securing handle 12 to mop head 14. This is accomplished by the cooperative action between handle socket member 120 and handle pivot shafts 122 and 124 integrally formed with top and bottom center blocks 30 and 32, respectively. Handle pivot shaft 122 is formed at th end of an inclined portion 126 of top center block 30 and handle pivot shaft 124 is formed at the end of a similarly inclined portion 128 of bottom center block 32. Socket member 120 is provided with an ear 130 having an aperture 132 for receiving handle pivot shaft 122. When top and bottom center blocks 30 and 32 are interlocked together, handle pivot shafts 122 and 124 form an aligned two-part shaft which pivotably secures socket member 120 to mop head 14 via top and bottom center blocks 30 and 32.

The interlocking connection between top and center blocks 30 and 32 is reinforced by an additional locking tab 140 depending from handle pivot shaft 122 and a locking edge 142 molded adjacent handle pivot shaft 124. The space between the back surface of bottom center block 32 and locking tab 140 may be filled by a separate locking key 143, best seen in FIGS. 4, 8 and 9. Key 143 has a pair of locking tabs 144 and 146 for engaging locking surfaces (not shown) and serves a function similar to reinforcing tabs 110, 112 and 114. It is not necessary for operation of the invention but does add somewhat to structural strength.

Figure 3:
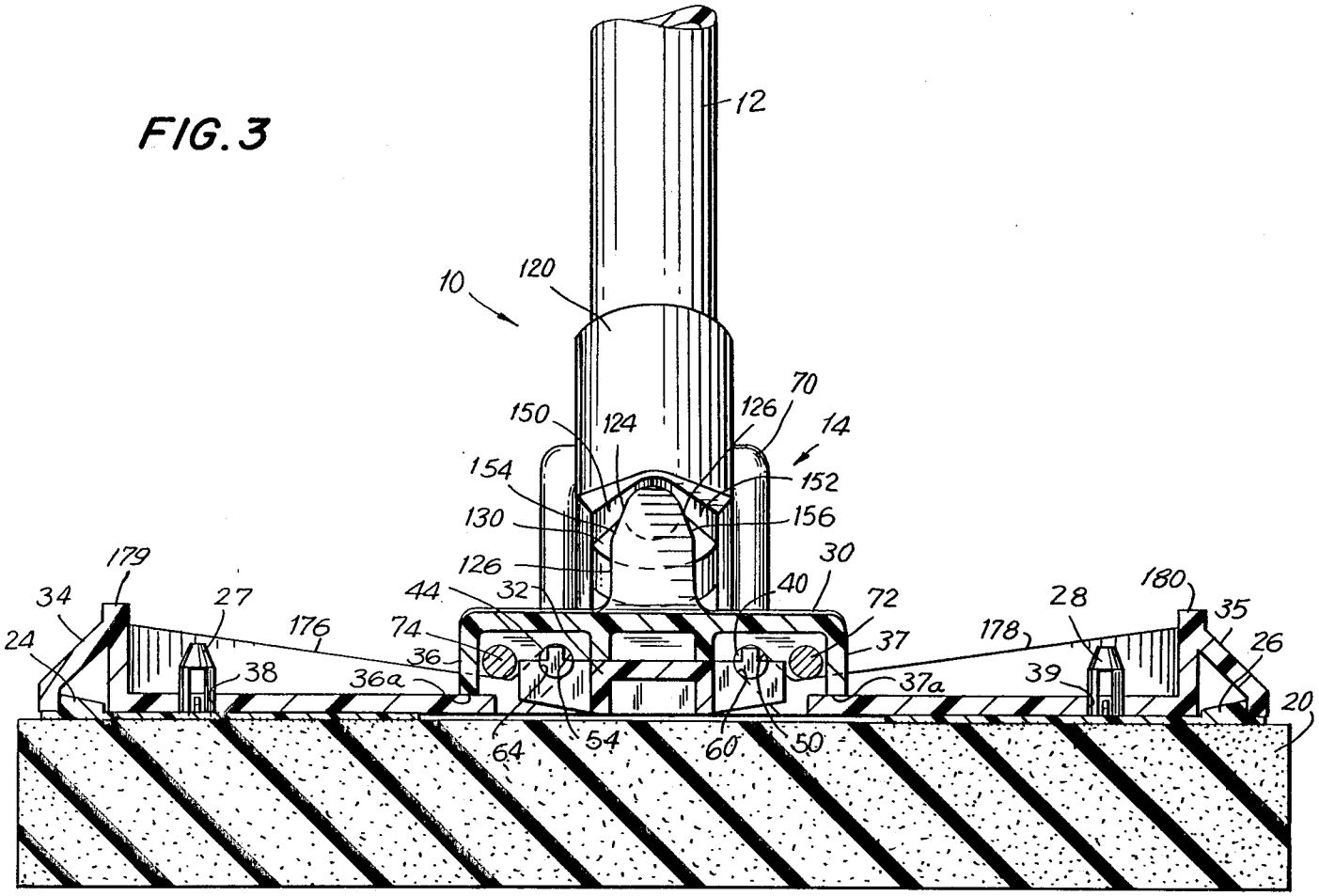
FIG. 3 is a cross-sectional elevation view of FIG. 2 taken along the line 3—3.

Socket member 120 is provided with limiting surfaces 150 and 152 for limiting the degree to which handle 12 may pivot about handle pivot shafts 122 and 124 (best seen in FIGS. 3 and 6). It will be understood that socket member 120 and consequently, handle 12 may rotate about pivot shaft 122, 124 until limit surfaces 150 and 152 contact the sides 154 and 156 of rising ramp member 126.

Another novel aspect of mop 10 is the connection between connecting link 172 and actuating member 70. As will be best seen by reference to FIGS. 2 and 4, the assembly and operation of the invention are enhanced by the novel construction of these components. It will be understood that there is a predetermined gap between ends 76 and 78 of actuating member 70. This gap is sufficient to receive the thickness of end 180 of link 172 in order to enable the assembly of these two components. As best seen in FIG. 4, end 180 has a circular aperture 182 and a rectangular aperture 184, the latter being superimposed on the circular aperture and oriented at a predetermined angle A relative to the axis of linke 172. Aperture 182 must be sufficient to enable end 180 to slide over the body of actuating member 70 and become engaged with similarly sized shaft portion 186 thereof. As best seen in FIG. 2, shaft portion 186 is aligned with and bounded by flattened portions 187 and 188. The maximum width of sections 187 and 188 is slightly smaller than the length of aperture 184 to enable end 180, in the proper orientation, to pass over the flattened portions 187 and 188. It will be understood that the orientation of linke 172 to actuating arm 70 during this assembly process is necessarily different than the orientation between these two components during normal use of mop 10. Flattened portions 187 and 188 are generally aligned with portion 189 of actuating member 70 and the orientation of rectangular aperture 184 to the axis of link 172 must be chosen in order keep end 180 between flattened portions 187 and 188 to to prevent end 180 from becoming disengaged from shaft portion 186 during operation.

The assembly of the various components of mop head 14 is considerably simpler than other butterfly-type sponge mops. A representative assembly process will be described in order to provide a better understanding of the invention. Initially, top center block 30 may be upside down in a suitable jig in order to receive the remaining components. Actuating member 70 with the connecting link in place may then be placed on the bottom of center block 30 with the ends 76 and 78 partially retained in semi-circular detents 82 and 84. It is noted that the arms of actuating member 70 need not be compressed as in some prior art butterfly-type sponge mops. Presser plates 34 and 35 may then be placed so their respective pivot shafts 40, 42 and 44, 46 are partially retained in semi-circular detents 50, 52 and 54, 56, respectively. Socket attachment 120 may be then placed on handle pivot shaft 122. Bottom center block 32 may then be snapped into place engaging the various locking arms and corresponding locking edges. Locking key 143 may be snapped into place to complete the assembly. It will be understood that the top and bottom center blocks may be molded in one hinged piece with the top and bottom blocks joined along one edge so that, during assembly, the bottom portion need only be folded over the top portion. The various components are now interlocked together with the exception of sponge 20 which may easily be snapped into place via retaining pins 27 and 28. The resiliency of the sponge serves to keep the presser plates open and substantially parallel during use without the need for any auxiliary springs.

The operation of mop 10 will be understood by reference to the drawings. When a user desires to wring out sponge 20, handle 170 is slidably moved down handle 12 thereby causing connecting link 172 to pivot actuating member 70 about the pivot axis formed by its ends 76 and 78. This causes parallel arms 72 and 74 to engage ramp surfaces 176 and 178 in a conventional manner to urge pressure plates and sponge into the phantom position shown in FIG. 5. Stops 179 and 180 are provided to limit the motion of actuating member 70.

It will be understood by those skilled in the art that numerous modifications and improvements may be made to the preferred embodiments of the invention disclosed herein without departing from the spirit and scope thereof.

What is claimed is:

1. In a butterfly-type mop having an actuating member pivotable about a pivot axis for moving parts of an absorbent member toward each other and a handle for moving said actuating member, the improvement comprising:

a connecting link interposed between said actuating member and said handle;

a connecting link engaging shaft portion on said actuating member, said shaft portion parallel to the pivot axis of said actuating member;

a pair of generally flattened link retaining portions aligned with and on either side of said shaft portion, said link retaining portions having a width in a predetermined direction greater than the diameter of said shaft portion, said link retaining portions having a first predetermined angular orientation relative to the body of said actuating member;

an actuating member engaging portion provided on said connecting link for engaging said shaft portion, said engaging portion provided with a circular aperture having a diameter slightly greater than said shaft portion and a rectangular aperture superimposed on said circular aperture, said rectangular aperture being slightly greater than the largest cross-section of said link retaining portions, said rectangular aperture oriented at a second predetermined angle relative to the axis of said connecting link, whereby said connecting link may be connected to said shaft portion and, upon actuation of said handle, rotated relative thereto within a predetermined range without disengaging said actuating member engaging portion from said shaft portion.

* * * * *